United States Patent [19]

Ahs

[11] Patent Number: 4,699,324

[45] Date of Patent: Oct. 13, 1987

[54] COMBINED SCREENING AND REJECT REDUCTION

[75] Inventor: Bjorn Ahs, Karlstad, Sweden

[73] Assignee: Kamyr AB, Karlstad, Sweden

[21] Appl. No.: 874,119

[22] Filed: Jun. 13, 1986

[30] Foreign Application Priority Data

Jun. 18, 1985 [SE] Sweden ..... 8503003

[51] Int. Cl.[4] ..... B02C 23/08

[52] U.S. Cl. ..... 241/21; 241/24; 241/28; 241/81; 241/245; 241/259.1

[58] Field of Search ..... 209/273, 358; 210/415; 162/4; 241/60, 261.1, 259.1, 24, 259.2, 20, 81, 74, 21, 46.17, 28, 46.06, 46.04, 46.15, 245

[56] References Cited

U.S. PATENT DOCUMENTS

| | | | |
|---|---|---|---|
| 3,375,776 | 4/1968 | Dyson | 241/46.06 X |
| 4,396,161 | 8/1983 | Ruokolainen et al. | 241/81 |
| 4,543,181 | 9/1985 | Greenwood . | |

FOREIGN PATENT DOCUMENTS

| | | |
|---|---|---|
| 955563 | 10/1974 | Canada . |
| 309715 | 3/1969 | Sweden . |
| 361183 | 10/1973 | Sweden . |

*Primary Examiner*—Mark Rosenbaum
*Attorney, Agent, or Firm*—Nixon & Vanderhye

[57] ABSTRACT

A device for screening fluidizable suspensions, such as medium consistency (e.g. 6–15 percent solids) paper pulp includes a housing with a main suspension inlet and a main (rejects) outlet. A rotor having a plurality of ribs is mounted in the housing for rotation about an axis. A stationary screen is disposed in the housing between the main inlet and outlet. The stationary screen defines, with the housing, a chamber, and the rotor is positioned so that the ribs sweep past the screen, with only a small clearance between the screen and ribs. Between the screen and the outlet grinding elements are provided, comprising a stationary grinding ring connected to the housing, and a movable grinding ring connected to the rotor for rotation with the rotor. The grinding elements define a grinding slot between them. The grinding slot is adjustable either by replacing one or both of the grinding rings, or by forming the grinding elements so that they are conical and adjusting the axial position of the rotor in the housing. Vanes mounted on the rotor are disposed downstream of the grinding elements and effect shive reduction as well as pumping rejects out of the main outlet.

18 Claims, 3 Drawing Figures

FIG. 1
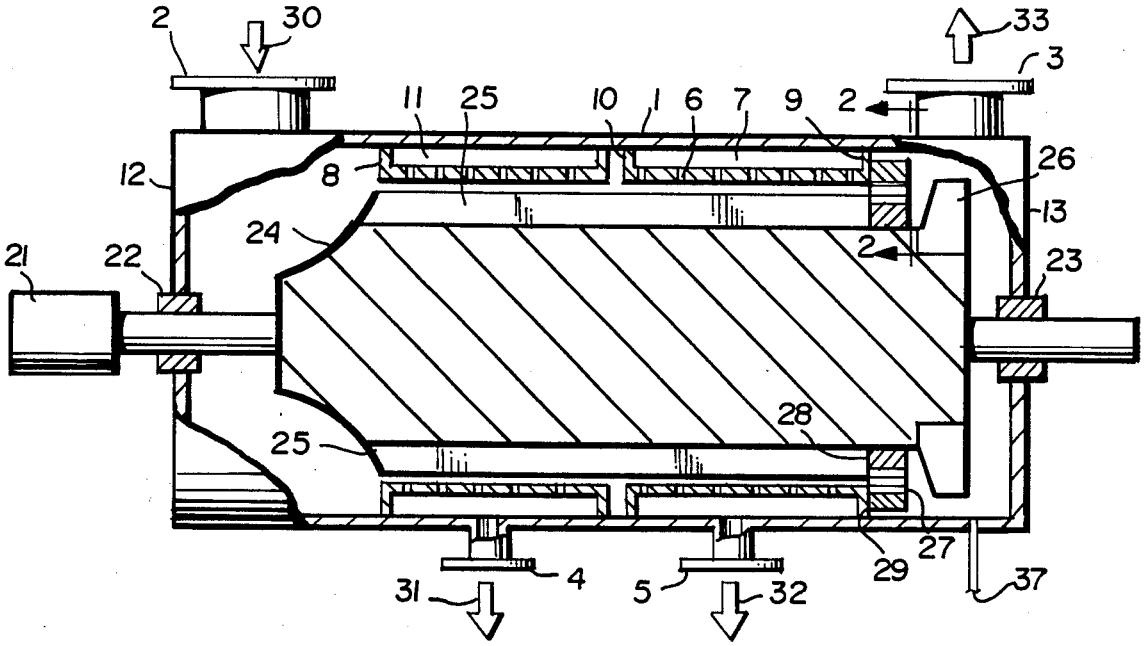
FIG. 2
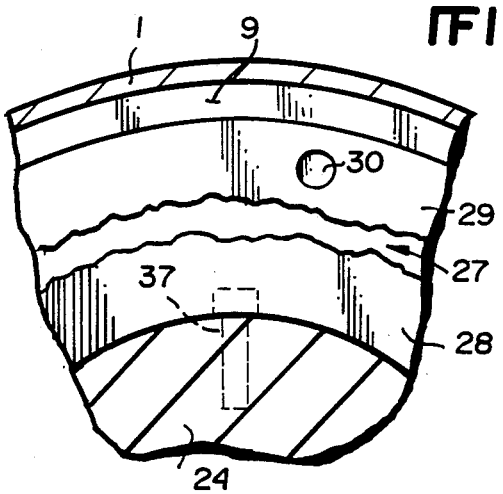
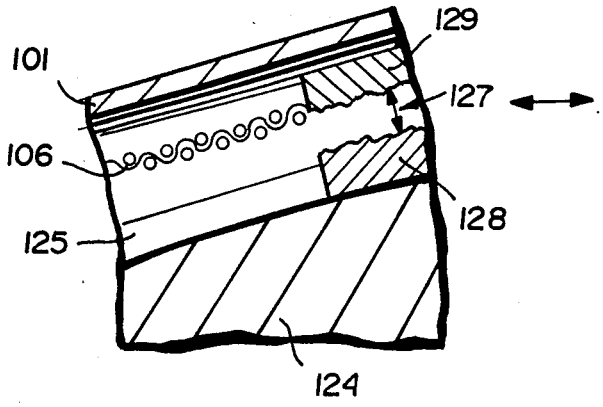
FIG. 3

COMBINED SCREENING AND REJECT REDUCTION

BACKGROUND AND SUMMARY OF THE INVENTION

In the screening of fluidizable suspensions, such as medium consistency paper pulp, it is desirable to utilize a simple yet effective apparatus, and one which will allow the production of a number of different accept streams. Medium consistency pulp typically is pulp having a consistency of about 6–15 percent, and most typically within the range of about 8–12 percent solids. In order to effectively screen such suspensions, it is necessary to fluidize them by producing pulsations and shear forces in the suspension. When the suspension is fluidized the fibers or other solid materials therein move relative to each other, and can be separated according to different sizes, shapes, or weights utilizing an appropriate screening apparatus.

In co-pending application Ser. No. 836,123 filed Mar. 4, 1986 (the disclosure of which is hereby incorporated by reference herein) a simple yet effective screening device which is particularly adapted for screening medium consistency pulp (although it may be utilized in the screening of other fluidizable suspensions) is illustrated. That screening device is typically utilized with chemical pulps, or mechanical pulps, such as TMP, CTMP, or the like. While the screening device illustrated therein is eminently practical, it has been found according to the present invention that such a device may be made even more useful by effecting reduction of shives, and other components of the rejects, within the screening device housing itself.

According to the present invention, for a screening device such as illustrated in said co-pending application Ser. No. 836,123, or a like screening device having a rotor which is rotatable with respect to a screen, rejects refining is provided directly in the screen housing itself by providing first and second grinding elements downstream of the screening means, that is between the screens and the rejects outlet from the housing. The grinding elements comprise a first element operatively mounted to the housing, and a second element operatively mounted to, and rotatable with, the rotor. The grinding elements preferably are in the form of rings which are removably attached to the housing and the rotor, respectively, and define a grinding slot between them. The dimensions of the grinding slot may be adjusted by replacing one or both of the annular grinding elements, or by forming the grinding elements so that they have a conical shape and adjusting the axial position of the rotor within the housing.

It has also been found, according to the present invention, that further shive reduction can be effected by utilizing vanes attached to the rotor, downstream of the grinding elements, which vanes simultaneously effect pumping of the rejects out of the main outlet. The vanes are as described in said co-pending application Ser. No. 836,123.

According to the present invention a method of treating a suspension of finely comminuted cellulosic fibrous material also is provided. The method comprises the following steps: (a) Introducing suspension having a consistency between about 6–15 percent into the housing inlet. (b) Effecting fluidization of the suspension within the housing to effect screening thereof, at least one accept stream being discharged from the housing through said at least one accepts outlet. (c) During screening of the suspension, effecting thickening of the suspension so that the suspension is thickened to a consistency of between about 15–20 percent. And (d), effecting reduction of the reject material in the thickened suspension prior to discharging the reject material out of the main outlet. Step (d) is practiced by passing the rejects through a grinding slot defined by the relatively rotatable grinding elements. Further shive reduction, and powered discharge of the rejects from the housing, is practiced by supplying dilution liquid to the suspension after grinding so that it is diluted to a consistency of between about 6–15 percent, and then acting on the suspension with rotating vanes (which effect the further shive reduction and pump the rejects out of the housing). Further reject reduction can be provided exterior of the housing, too, with a significant reduction in the energy expended in practicing the subsequent refining to get the desired results.

It is the primary object of the present invention to provide a device and procedure which are eminently suited for effecting screening of paper pulp (preferably medium consistency), or the like, while additionally effecting reduction of shives and other rejects material. This and other objects of the invention will become clear from an inspection of the detailed description of the invention and from the appended claims.

BRIEF DESCRIPTION OF THE DRAWINGS

FIG. 1 is a side view, partly in cross-section and partly in elevation, of an exemplary screening and rejects reducing device according to the present invention;

FIG. 2 is a longitudinal cross-section, partial, detail view primarily illustrating the grinding elements of the device of FIG. 1, and taken along lines 2—2 of FIG. 1; and FIG. 3 is a side cross-sectional, partial, detail view of another exemplary embodiment of grinding elements which may be utilizable in a device according to the invention.

DETAILED DESCRIPTION OF THE DRAWINGS

In the preferred embodiment of the device according to the present invention, most of the components are the same as for the device illustrated in said co-pending application Ser. No. 836,123, with the addition of grinding means for effecting reduction of shives and other components of the rejects. That is, an exemplary device according to the invention includes a housing 1 which is circular in cross-section, and includes a main inlet 2 at one end thereof, and a main (rejects) outlet 3 at the opposite end thereof from the inlet 2. End walls 12 and 13 are provided, and a rotor 24 is disposed in the housing and extends generally along the length thereof. The rotor is rotatable about an axis (preferably a horizontal axis) defined by the shaft 20, the shaft being mounted in bearings 22 and 23 at the end walls 12 and 13, for rotation with respect to the housing 1. A suitable powered driving device 21 comprises means for effecting rotation of the rotor 24 about its axis.

Disposed on the periphery of the rotor 24 are a plurality of ribs 25. The ribs may extend completely axially along the length of the rotor 24, or may have an arcuate configuration (that is extend in a generally screw-thread manner along the rotor 24). The powered means 21 rotates the rotor 24 and ribs or blades 25 in such a way that the suspension flowing in the housing 1 is fluidized. For example, for a pulp having a consistency of between about 6–15 percent, if the rotor 24 is rotated at 1500 revolutions per minute (by a motor 21 which is a 250 kW motor), the ribs or blades 25 will have a speed of about 20–25 m/second which will be sufficient to fluidize and screen approximately 6 tons of pulp per hour.

The device according to the invention also includes a stationary screen means operatively disposed in the housing 1 between the inlet 2 and outlet 3, the screen means defining, with the housing 1, a chamber. The screen means may comprise a cylindrical screen body 6 which defines a volume between it and the housing 1. The ends of the screen 6 are connected to the housing by end rings 8 and 9. Note that the rotor 24 is mounted within the housing 1 with respect to the cylindrical screen 6 so that the blades 25 sweep past the interior cylindrical surface of the screen 6 during rotation, a small clearance being provided between the blades 25 and the screen 6.

The device also preferably comprises means for dividing the chamber between the screen 6 and housing 1 into a plurality of accept chambers—chambers 7 and 11 in FIG. 1. The dividing means preferably takes the form of the wall 10, which is a ring shaped wall which extends generally perpendicular to the axis of rotation defined by the shaft 20, and generally parallel to the direction in which suspension 30 is introduced into the inlet 2. Each accept chamber 11, 7 has associated therewith its own accept outlet (outlets 4, 5, respectively), so that two different accept streams 31, 32 are produced.

The rotor 24 also preferably has associated therewith a plurality of vanes 26 at the portion thereof adjacent the main outlet 33. The vanes 26 act like vanes of a pump, and facilitate movement of the rejects out of the housing 1 in a rejects stream 33. Dilution liquid (e.g. water) may be added to the reject stream via inlet 37 to facilitate the flow of rejects out of outlet 3.

Utilizing the apparatus of FIG. 1, it will thus be seen that the introduced suspension 30 flows primarily axially through the housing 1, is divided into two accept streams 31, 32, and then the rejects are pumped out through outlet 3 in the rejects stream 33.

While the device of FIG. 1 has been illustrated with only two accept chambers 11, 7, it is to be understood that three, or even more, accept chambers may be provided.

The device according to the present invention includes grinding means disposed between the downstreammost portion of the screen 6 and the rejects outlet 3. The grinding means, as illustrated in FIGS. 1 and 2, preferably includes a first grinding element 29 which is stationary, and is operatively connected to the housing 1. This may be accomplished, as illustrated schematically in FIGURE 2, by connecting an annular shaped grinding element 29 with removable fasteners to the ring 9, the removable fasteners being illustrated schematically by screws 30 in FIG. 2.

The grinding means also comprises a second grinding element, preferably comprising the annular element 28 which is operatively mounted to the rotor 24 for rotation therewith. The annular element 28 preferably is also removably mounted, for example as illustrated schematically in FIG. 2 by screws 36, by removable fasteners to the rotor 24. The fasteners, as schematically illustrated in FIG. 2, are recessed so that they do not interfere with the grinding surface of the element 28.

As seen in both FIGS. 1 and 2, the elements 28, 29 define a grinding slot 27 between them. The suspension which passes through the slot 27 is the rejects stream, and the grinding elements 28, 29 act on the rejects stream to effect reduction of the shives and other components thereof. As illustrated in FIG. 2, the juxtaposed surfaces of the elements 28, 29 are contoured so as to have ribs, grooves, projections, or like conventional components which cooperate to effect the refining (grinding) of the solids in the rejects stream.

It is noted that utilization of the device according to the invention inherently results in thickening of the suspension prior to presentation to the grinding slot, which thickening action is desirable to facilitate the refining action. Typically, if a paper pulp suspension having a consistency of between about 6–15 percent is introduced into inlet 30 (preferably with a consistency of between about 8–12 percent), by the time the suspension has passed the screen 6, and accepts have been removed through the accept chambers (e.g. 7, 11), the pulp will have a thickened consistency between about 15–20 percent.

Utilizing the device according to the present invention, it has also been found that the vanes 26, in addition to performing their pumping action, also effect further shives reduction. It is desirable to add dilution liquid in the chamber containing the vanes 26 to facilitate the pumping action which dilution liquid reduces the consistency of the suspension back to its approximate original consistency (that is between about 6–15 percent, and preferably between about 8–12 percent).

In the actual utilization of the device as described above, operated at a rotational speed such that the rotor blades 25 had a velocity of about 20–25 meters per second and effected fluidization of the suspension, a considerable reduction of shives in the rejects flow was obtained. As a matter of fact, the amount of energy required to effect the level of shives reduction that was achieved utilizing the device according to the invention was approximately one-half—one-third the amount of energy that was necessary to operate a conventional refiner downstream of the screening device. If a conventional refiner is disposed downstream of the rejects outlet 3 in the device according to the present invention, further refining can be practices at a considerably reduced total energy consumption since a great deal of the shive reduction has taken place within the device 1 by the action of the grinding elements 28, 29, and the action of the vanes 26.

According to the present invention, it is also desirable to be able to adjust the dimensions of the slot 27 to control the degree of refining action provided by the elements 28, 29, depending upon the desired end results, the particular material being acted upon, etc. According to one aspect of the present invention, this adjustment is facilitated by providing a second set of elements 28, 29, corresponding to the first set of elements only being dimensioned so that when they are juxtaposed in their operable position, the dimensions of the slot 27 are different. That is merely by removing one or both of the elements 28, 29 and replacing it or them with another or other elements having different effective diameters, the dimensions of the slot 27 may be changed.

Another manner of effecting adjustment of the effective dimensions of the grinding slot may be provided utilizing the device as illustrated schematically in FIG.

3. In FIG. 3, components corresponding to the embodiment illustrated in FIGS. 1 and 2 have the same two digit reference numeral, only preceded by a "1".

In the embodiment of FIG. 3, note that the rotor 124, screen 106, and grinding elements 128, 129 are all generally conical. In particular, the grinding elements 128, 129 taper toward the axis of rotation of the rotor 124 as one moves from the rejects outlet toward the suspension inlet (toward the left in FIG. 3). In FIG. 3, the conical angle, and the dimensions of the grinding slot 127 have been exaggerated for clarity of illustration.

Utilizing the device of FIG. 3 it will be seen that all that is necessary in order to adjust the dimensions of the grinding slot 127 is to reposition the rotor 124 along its axis (that is with respect to the housing 101). This is easily accomplished merely by repositioning the rotor shaft (not shown in FIGURE 3) with respect to the bearings (also not shown in FIG. 3) receiving it.

The preferred device according to the present invention also includes the other components of the apparatus illustrated in said co-pending application Ser. No. 836,123. That is, for example, a portion of the screen means associated with an accept chamber is different than the portion of the screen means associated with another of the accept chambers, and the size, shape, and/or configuration of the perforations, slits, or holes formed in the screen means, so that the suspension discharged from the respective accept chambers will have different characteristics. Also, the device according to the invention can be constructed, as illustrated in FIGS. 3 and 4, etc. of the co-pending application, so that the rotor is disc-shaped, and in which case the grinding elements can be provided on the outer periphery of the rotor and the housing adjacent the outer periphery of the rotor.

It will thus be seen that according to the present invention a method and device have been provided which effect energy efficient refining of shives, and other reject material, in the rejects stream in a screening device. While the invention is particularly suited for medium consistency pulp, it is also applicable to other suspensions, and other consistencies of pulp.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent devices and methods.

What is claimed is:

1. A device for screening a fluidizable suspension comprising: a housing including a main inlet and a main outlet; a rotor having a plurality of ribs formed thereon; stationary screen means operatively disposed in said housing between said main inlet and outlet; said stationary screen means defining, with said housing, a chamber; means for mounting said rotor in said housing for rotation about an axis, with said ribs rotating past said stationary screen means with a small clearance between said stationary screen means and said ribs enabling flow of the suspension in an axial direction; means for effecting primary and secondary screening within the same device and of the same axial flow comprising means on the outlet side of said screen for dividing said chamber into a plurality of accept chambers; an accept outlet operatively associated with each accept chamber and extending outwardly from said housing; and means for grinding suspension solids before passage through said main outlet, said grinding means comprising a first, stationary element operatively connected to said housing, and a second element, concentric with said first grinding element, operatively connected to said rotor and rotatable with said rotor, said first and second grinding elements defining a grinding slot therebetween; said grinding elements located between said screen means and said main outlet.

2. A device as recited in claim 1 for effecting further reduction of, and pumping of, suspension solids after they have been acted upon by said grinding means, said further reduction and pumping means comprising a plurality of vanes disposed on said rotor adjacent said main outlet, and between said grinding means and said main outlet.

3. A device as recited in claim 2 further comprising dilution liquid adding means for adding dilution liquid to the suspension which passes the screening means, to facilitate discharge of rejects from the housing by said further reduction and pumping means.

4. A device as recited in claim 2 further comprising means for adjusting the grinding slot so that the degree of reduction provided by said grinding means is adjustable.

5. A device as recited in claim 4 wherein said concentric first and second grinding elements have a generally conical configuration, both tapering toward the axis of rotation of said rotor in the direction from said main outlet to said main inlet; and wherein said grinding slot adjustment means comprises means for adjusting the axial position of said second grinding element with respect to said first grinding element, the conical configurations of said grinding elements defining a differently dimensioned grinding slot depending upon the axial position of said rotor with respect to said housing.

6. A device as recited in claim 4 wherein said first and second grinding elements comprise a first set of grinding elements, said first and second grinding elements each being generally annular and each being removably attached in a position to define said grinding slot, said first element being removably attached to said housing and said second element being removably attached to said rotor; and wherein said means for adjusting the grinding slot comprises at least a second set of first and second grinding elements, said second set of elements having different dimensions than said first set of elements so that when said second set of elements is disposed in said device, the dimensions of said grinding slot are different than when said first set are disposed within said device.

7. A device as recited in claim 6 wherein one of said elements of said second set, and only one of said elements of said second set, also comprises an element of said first set.

8. A device as recited in claim 1 further comprising means for adjusting the grinding slot so that the degree of reduction provided by said grinding means is adjustable.

9. A device as recited in claim 8 wherein said concentric first and second grinding elements have a generally conical configuration, both tapering toward the axis of rotation of said rotor in the direction from said main outlet to said main inlet; and wherein said grinding slot adjustment means comprises means for adjusting the axial position of said second grinding element with respect to said first grinding element, the conical configurations of said grinding elements defining a differently dimensioned grinding slot depending upon the axial position of said rotor with respect to said housing.

10. A device as recited in claim 1 wherein said means for dividing said chamber comprises at least one wall extending perpendicular to said axis of rotation, and wherein said accept chambers are generally annular in shape, and axially spaced from each other along said housing and axis of rotation of said rotor.

11. A device as recited in claim 1 wherein the portion of said screen means associated with an accept chamber is different than the portion of the screen means associated with another of the accept chambers, in the size, shape, and/or configuration of perforations, slits, or holes formed in the screen means.

12. A device for screening a fluidizable suspension comprising: a housing including a main inlet and a main outlet; a rotor having a plurality of ribs formed thereon; stationary screen means operatively disposed in said housing between said main inlet and outlet; said stationary screen means defining, with said housing, a chamber; means for mounting said rotor in said housing for rotation about an axis, with said ribs rotating past said stationary screen means with a small clearance between said stationary screen means and said ribs;

means for grinding suspension solids before passage through said main outlet, said grinding means comprising a first, stationary element operatively connected to said housing, and a second element, concentric with said first grinding element, operatively connected to said rotor and rotatable with said rotor, said first and second grinding elements defining a grinding slot therebetween; said grinding elements located between said screen means and said main outlet; and means for effecting further reduction of, and pumping of, suspension solids after they have been acted upon by said grinding means, said further reduction and pumping means comprising a plurality of vanes disposed on said rotor adjacent said main outlet for rotation therewith about said axis, and between said grinding means and said main outlet.

13. A device as recited in claim 12 further comprising dilution liquid adding means for adding dilution liquid to the suspension which passes the screening means, to facilitate discharge of rejects from the housing by said further reduction and pumping means.

14. A device as recited in claim 12 further comprising means for adjusting the grinding slot so that the degree of reduction provided by said grinding means is adjustable.

15. A device as recited in claim 14 wherein said concentric first and second grinding elements have a generally conical configuration, both tapering toward the axis of rotation of said rotor in the direction from said main outlet to said main inlet; and wherein said grinding slot adjustment means comprises means for adjusting the axial position of said second grinding element with respect to said first grinding element, the conical configurations of said grinding elements defining a differently dimensioned grinding slot depending upon the axial position of said rotor with respect to said housing.

16. A device as recited in claim 12 wherein said first and second grinding elements comprise a first set of grinding elements, said first and second grinding elements each being generally annular and each being removably attached in a position to define said grinding slot, said first element being removably attached to said housing and said second element being removably attached to said rotor; and wherein said means for adjusting the grinding slot comprises at least a second set of first and second grinding elements, said second set of elements having different dimensions than said first set of elements so that when said second set of elements is disposed in said device, the dimensions of said grinding slot are different than when said first set are disposed within said device.

17. A device as recited in claim 16 wherein one of said elements of said second set, and only one of said elements of said second set, also comprises an element of said first set.

18. A method of acting upon a suspension of comminuted cellulosic fibrous material including shives and other reject material therein, utilizing a device including a housing with a main inlet and a main outlet, screening means between said main inlet and said main outlet, and at least one accepts outlet from the screening means, the housing main outlet comprising a rejects outlet; said method comprising the steps of:

(a) introducing suspension having a consistency between about 6–15 percent into the housing inlet;

(b) effecting fluidization of the suspension within the housing to effect screening thereof, at least one accept stream being discharged from the housing through said at least one accepts outlet;

(c) during screening of the suspension, effecting thickening of the suspension so that the suspension is thickened to a consistency of between about 15–20 percent; and (d) effecting reduction of the reject material in the thickened suspension prior to discharging the rejects material out of the main outlet, said reduction being practiced by grinding the rejects material by passage of the thickened suspension in a grinding slot between relatively rotating grinding elements and by impacting the thickened suspension, after passage through the grinding slot, with a plurality of rapidly rotating vanes, and diluting the thickened suspension so that it again has a consistency of between about 6–15 percent prior to and simultaneously with impacting by the vanes, so that the vanes effect shive reduction while simultaneously effecting pumping of the reduced rejects material through the main outlet.

* * * * *